US006684446B2

(12) United States Patent
Salmon

(10) Patent No.: US 6,684,446 B2
(45) Date of Patent: Feb. 3, 2004

(54) FRAME FOR A WIPE MOP COVER AND WIPING SYSTEM

(75) Inventor: Dirk Salmon, Wertheim (DE)

(73) Assignee: Vermop Salmon GmbH, Wertheim (DE)

( * ) Notice: Subject to any disclaimer, the term of this patent is extended or adjusted under 35 U.S.C. 154(b) by 60 days.

(21) Appl. No.: 09/969,560

(22) Filed: Oct. 2, 2001

(65) Prior Publication Data

US 2002/0078520 A1 Jun. 27, 2002

(30) Foreign Application Priority Data

Oct. 5, 2000 (DE) ..... 100 49 334

(51) Int. Cl.[7] ..... A47L 13/20; A47L 13/256

(52) U.S. Cl. ..... 15/147.2; 15/144.2; 15/228

(58) Field of Search ..... 15/144.2, 147.2, 15/228, 244.2

(56) References Cited

U.S. PATENT DOCUMENTS

| | | | | |
|---|---|---|---|---|
| 4,564,969 | A | * | 1/1986 | Heinonen |
| 5,455,980 | A | * | 10/1995 | Buchanan |
| 5,461,749 | A | * | 10/1995 | Ahlberg |

FOREIGN PATENT DOCUMENTS

| | | |
|---|---|---|
| DE | 9415071 | 9/1994 |
| WO | WO 97/18744 | 5/1997 |
| WO | WO 99/60913 | 12/1999 |

* cited by examiner

*Primary Examiner*—Randall E. Chin
(74) *Attorney, Agent, or Firm*—Wolf, Greenfield & Sacks, P.C.

(57) ABSTRACT

A frame (2) for a wipe mop cover (3) comprises a substantially flat profile element (13) having two faces, two side ends, a leading end and a trailing end; two end caps (7) for application in the vicinity of the side end on the profile element (13), a universal joint (14) for connecting a handle for application in the vicinity of the trailing end substantially in the middle thereof on the profile element (13) and permitting rotation of the profile element about a spindle (12) substantially parallel to the trailing end.

15 Claims, 2 Drawing Sheets

FRAME FOR A WIPE MOP COVER AND WIPING SYSTEM

FIELD OF THE INVENTION

The invention relates to a frame for a wipe mop cover and a wipe system as used for cleaning floor coverings.

Smooth floor coverings are usual cleaned with the aid of a wipe mop. Belonging to one such wipe mop is a frame for a mop cover, the frame requiring to be secured to a handle so that it can be manually negotiated with the mop cover held in place. The frame serves to reliably hold the mop cover tensioned to the required degree so that the mop cover forms a surface area with which the floor can be cleaned. The mop cover is made of a fabric suitable for cleaning the floor concerned.

In addition to holding the mop cover, the frame for the wipe mop cover also serves to maintain the mop cover in good contact with the surface area being cleaned for implementing reliable cleaning, the frame thereby being guided on the handle in keeping with the manual negotiation thereof.

Prior Art

Technically, a wealth of different frames are known for mop covers, each differing by several aspects. For example, differences exist as to how the mop covers are applied thereto, as to their geometry or as to whether the mop cover is intended for single-sided or double-sided (reversible) use.

For applying the mop cover to the frame tie strings, Velcro or snap-action fasteners are known, for example, it also being known to provide pockets in the mop cover into which the end-pieces of the frame are inserted for securing the mop cover to the frame. However, using pockets for securing the mop cover to the frame is not suitable for reversible mop covers.

Many variants are likewise known as regards the geometry of the mop frame. On the one hand, mop frames are used having a substantially rectangular configuration as viewed from above, this usually meaning that the contact surface area wiping the floor is likewise rectangular. On the other, mop frames are known having a trapezoidal floor contact surface area. Both kinds of mop frames are used greatly differing in size, dictating more particularly the length of the mop frame, i.e. the dimension substantially perpendicular to the main wiping direction.

Attaching a handle to the frame is mostly done via a universal joint. Depending on the type of frame involved, more particularly depending on whether it is designed for single or reversible operation, the joint for connecting the frame to the handle is provided optionally either in the middle of the surface area of the frame or in the vicinity of one of its longitudinal edges.

One example of a reversible frame including a mop cover is described in the German utility model specification G 49 15 071.0. The face surface areas of this frame are substantially rectangular. Cross-sectionally it is trapezoidal in shape, tapered towards the leading longitudinal edge, i.e. the edge leading the main direction of movement. Velcro strip fasteners are provided in the interior of the pocket, the wiping surface area on the outside. In the vicinity of the trailing longitudinal edge Velcro strip fasteners are applied to each of the faces of the frame. These Velcro strip fasteners cooperate with companion means provided on the mop cover in thus securing the mop cover to the frame. The mop cover in this arrangement is configured pocket-shaped and adapted to the cross-sectional shape of the frame. Provided furthermore in the vicinity of the trailing edge of the mop frame is a universal joint forming the connection to a handle. The mop frame can be swivelled about this universal joint so that floor cleaning is optionally achieved by the one or other face in being used to clean the floor.

The mop frame as described in G 94 15 071.0 is made of a one-part element having substantially smooth surfaces and is configured with no cavities.

SUMMARY OF THE INVENTION

The invention is based on the objective of proposing a frame for a mop cover which permits flexible production as regards the geometry of the frame whilst being suitable for reversible operation and is cost-effective in production. Furthermore, the invention is based on the objective of proposing a wipe system featuring the aforementioned advantages.

This objective is achieved by a frame for a wipe mop cover comprising a substantially flat profile element having two faces, two side ends, a leading end and a trailing end; two end caps for application in the vicinity of said side ends on said profile element; and a universal joint for connecting a handle for application in the vicinity of said trailing end substantially in the middle thereof on said profile element and permitting rotation of said profile element about a spindle substantially parallel to said trailing end.

According to another aspect of the invention, a wipe system comprises a frame as described above, wherein the profile element is provided with at least one groove on at least one of the face surface areas, and at least one strip insertable into at least one groove for securing a mop cover to the frame.

The profile element may be configured as a tubular section having at least one cavity, and the at least one cavity may extend full length in the profile element. The wipe system may include at least one reinforcement part insertable into at least one cavity. The wipe system may include a spindle insertable into a round cavity and which, together with a companion piece on the handle, forms the universal joint.

The gist of the invention is to produce a frame for a wipe mop cover from a profile. This offers the advantage that the profile, which can be firstly fabricated as an endless profile, merely needs to be cut into profile elements corresponding to the desired length of the wipe mop before then being provided with end caps. By correspondingly configuring the end caps, contact surface areas of the frames differing in geometry can be simultaneously achieved without requiring a production line specially adapted to each geometry of the frame, since the profile elements are independent of the final geometry of the frame. The various geometries can now be achieved solely via the configuration of the end caps. It is likewise possible to adapt the size of the frame to particular requirements by cutting the profile into profile elements of corresponding size in accordance with the specifications. More particularly, flexible cost-effective production is now achieved without needing to sacrifice the advantages of a frame suitable for use reversible, by suitably applying a universal joint.

It is furthermore possible by suitably configuring the profile cross-sectionally and suitably selecting the material, for example aluminum, to configure the profile lightweight, directly affecting the weight of the frame. The lighter the frame, the less manual effort is needed in thus assuring good ergonomic performance.

The gist of the wipe system in accordance with the invention is to systemize a frame, made of a profile element and suitable for reversible operation, by the addition of strips or reinforcement parts. The strips and/or reinforcement parts are insertable into grooves or cavities in the frame profile, ensuring adequate stability being assured on long frames, even when the profile is configured as a tubular section, without sacrificing the advantages of lightweight design and flexible production. More particularly, by providing reinforcement strips for longish frames both short and long frames can be achieved with the same profile, it being possible, for example, to achieve frame lengths of approx. 25 cm to approx. 150 cm with reinforcement being of advantage for frame lengths exceeding 100 cm.

Systemizing the frame into a wipe system by strips for securing a mop cover to the frame offers, on the other hand, the additional advantage that these can be replaced when worn out, without needing the complete frame to be replaced. This ensures reliably adherence of the mop cover to the frame to make for long useful life of the frame. In conclusion, it is possible to insert an added attachment in the form of a spindle into a corresponding cavity in the frame, serving as the spindle for the universal joint forming the connection to a handle and which may be held in place like the other interior reinforcement elements, for example by friction contact.

Advantageous embodiments of the frame or wipe system are characterized in the remaining claims.

More particularly it is good practice for the frame to comprise a groove on at least one of its face surface areas, the cross-section of the profile element being correspondingly configured for this purpose.

Face surface areas of the frame in this sense are understood to be the surface areas which serve as wipe surface areas in wiping operation of the reversible frame, i.e. the surface areas coming into contact with the floor. The longitudinal direction is understood to be the direction in space as located in the plane of the frame and approximately transverse to the main wiping direction. Correspondingly, the sides of the frame ending its size in this direction in space are termed side ends. The direction perpendicular thereto in the plane of the frame is termed transverse direction, the corresponding ends as the leading end or trailing end, whereby the leading end is the one located leading in the main wiping direction, the trailing end being the one opposite thereto and in the vicinity of which the universal joint for the handle is fitted. In conclusion, thickness direction is understood to be the direction extending perpendicular to the two face surface areas.

Providing at least one groove on at least one of the face surface areas enables strips to be inserted into this groove including an affixing means, e.g. a Velcro affixing means. In configuring the mop cover with the corresponding companion piece to this affixing means, i.e. for example a companion piece to the Velcro affixing means (loop hooking pair), the mop cover can be secured to the frame once such strips have been inserted into the grooves in the profile element. Once the fastener strip, insertable into the groove, has become worn out, it can thus be simply replaced. Since this does not require the complete frame to be replaced, this solution is environmentally friendly whilst being cost-effective.

It is particular of advantage when at least one groove is provided on each of the face surface areas. Inserting a fastener strip in each of these grooves with the mop cover correspondingly configured enables it to be located U-shaped about the frame and fixed in place by the two fastener strips each inserted into a groove in each face surface area. It is good practice to provide these grooves to particular advantage in the vicinity of the trailing end on the face surface areas of the profile element since the mop cover can then be tensioned over its full surface area.

The grooves are preferably trapezoidally shaped cross-sectionally, the trapezoid being tapered towards the outer side of the profile element, i.e. in the direction of the wipe surface area. When fastener strips inserted in these grooves are likewise configured correspondingly trapezoidal, they can be fixed in place simply by being inserted into the frame, no additional means being needed to secure the strips.

The strips, inserted into the frame, may either extend over the full length of the profile element or may be shorter or longer than the profile element. If they are longer than the profile element, the end caps are to be configured correspondingly so that they accommodate the projecting ends of the reinforcement strips in concealing them in a cavity of the end caps.

There is in principle no limit to the number of the grooves on a face surface area of the profile element. It has been discovered, however, to be good practice to provide one or two grooves on each face surface area, into which depending on the kind of mop cover being used and the nature of the cleaning task involved—one or more fastener strips for the mop cover or smooth reinforcing strips are inserted in each side. Using two fastener strips ensures a particularly reliable tack of the mop cover to the frame which is particularly desirable in the case of heavy mop covers, heavy-duty cleaning as in the case of rough floor surface areas or the like. Grooves not provided with reinforcement strips are advantageously supplemented by smooth strips located flush with the profile element when inserted so that a smooth wipe surface area is formed with the profile element.

In accordance with one preferred embodiment, cavities are provided in the profile element, there being no limit to the number of the cavities as well as to the configuration thereof, although it is particularly of advantage when the cavities extend in the longitudinal direction of the profile element. This offers namely the possibility of inserting reinforcement elements into the cavities which may be necessary especially when the profile is cut to long profile elements, whereas when cut to short profile elements it is usually not necessary to stiffen the profile element by reinforcement elements. Configuring the profile as a hollow section has the advantage of the frame being particularly lightweight and ergonomic to use. It is, of course, just as possible to arrange the cavities otherwise, it more particularly not being a mandatory requirement, but often desired, that the cavities extend over the full length through the profile element.

Preferably a cavity of round cross-section is provided which in the vicinity of the trailing end extends substantially parallel thereto in the profile element. Simultaneously providing a full length recess in the profile element in the thickness direction, which interrupts the cavity and extends fully to the trailing end, enables a spindle to be formed by inserting a round reinforcing element into this round cavity, this spindle being engaged in operation by a handle joint for securing the handle to the frame. In this configuration the frame can thus be swivelled at the joint about the spindle. Production remains simple whilst enhancing flexibility.

It is good practice when the profile is configured symmetrical relative to a longitudinal centerline. In the case as cited above, it is thus to be preferred that a cavity of round cross-section is provided in the vicinity of both the trailing and leading end edge. This configuration permits particularly flexible production, since, for example, when parting the profile inclined lengthwise the same edge of the profile may serve alternantigly as the leading or trailing end of a frame.

It is good practice to configure the end caps closing off the frame at the side ends so that they render the profile element trapezoidal. This thus makes it possible, for example, to cut profile elements of rectangular cross-section, as viewed from above, from the profile which are rendered by correspondingly configured frame end caps into a trapezoidal frame for a wipe mop cover. This trapezoidal shape for a frame for a wipe mop cover is particularly favorable for cleaning comers and edges otherwise difficult to access. At the same time, a rectangular configuration of the profile is of advantage in cutting the individual profile elements since there is practically no waste in this case.

BRIEF DESCRIPTION OF THE DRAWINGS

The invention will now be detained purely by way of example with reference to the FIGS. in which.

DETAILED DESCRIPTION

Figure 1:
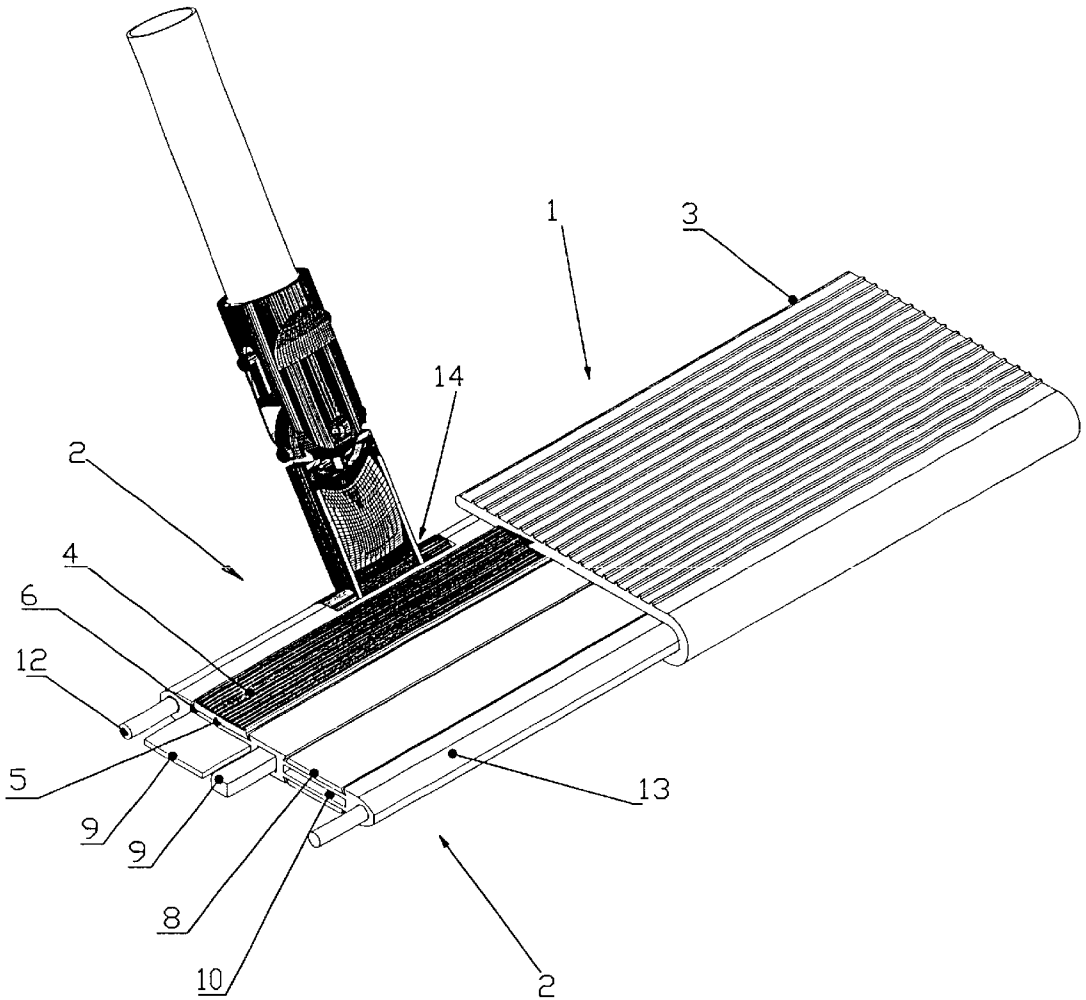
FIG. 1 is a view in perspective of a frame for a wipe mop cover, not showing the end caps to make for a better overview.

Referring now to FIG. 1 there is illustrated a view in perspective of a frame 2 in accordance with the invention for a wipe mop cover 3. In this arrangement, part of the frame (on the left as shown in FIG. 1) is illustrated without the wipe mop cover 3 applied, the other side of the frame 2 being shown including the wipe mop cover 3. It is to be noted that end caps are not shown in FIG. 1.

Figure 2:
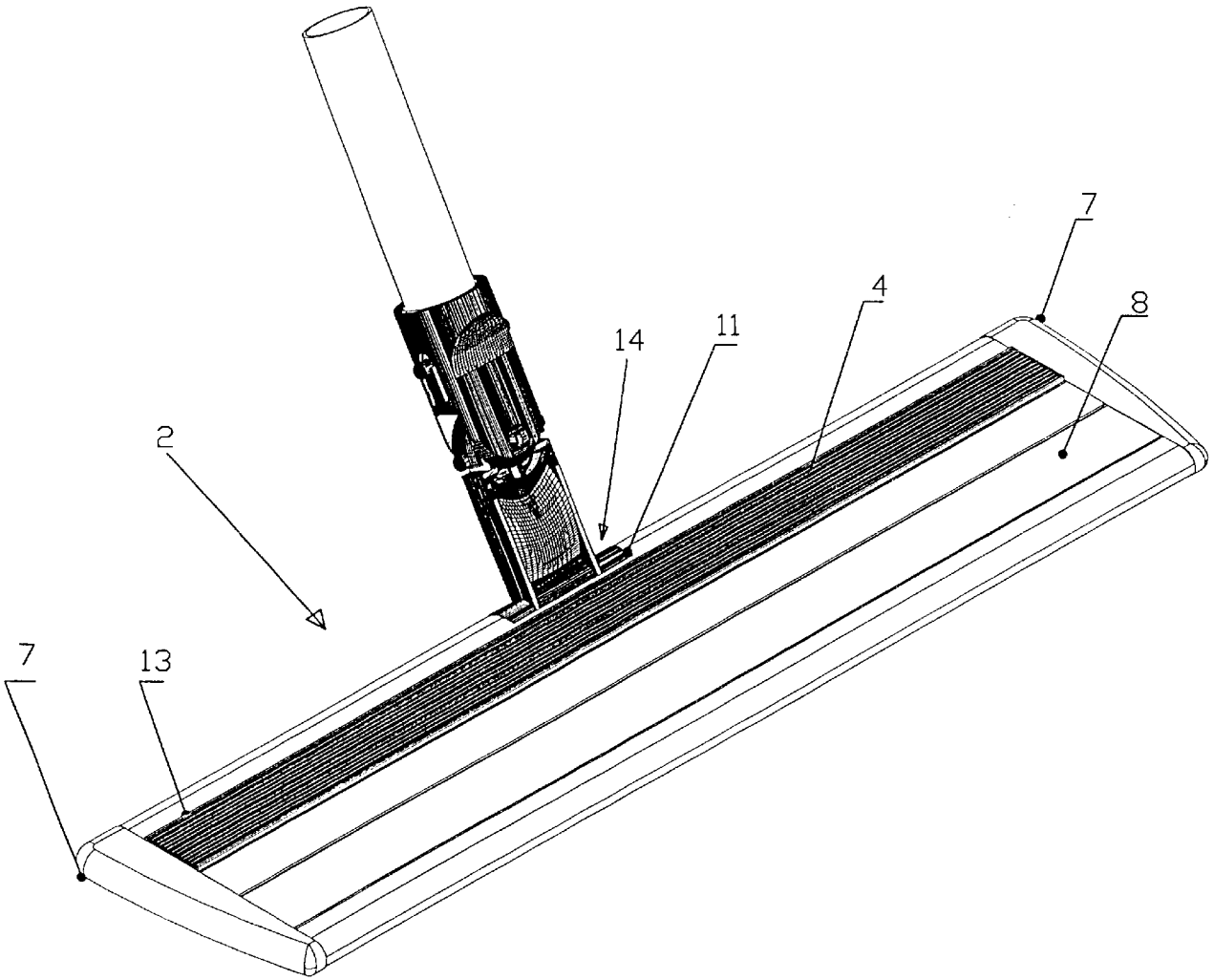
FIG. 2 is a view in perspective of a frame for a wipe mop cover showing the end caps mounted on the profile element.

Referring now to FIG. 2 there is illustrated a view of the frame 2 in accordance with the invention for a mop cover without the mop cover being affixed, but showing the end caps 7 applied.

In the embodiment as shown, the frame 2 in accordance with the invention comprises substantially one profile element 13. This profile element 13 may be made for example of aluminum or of some other suitable material, such as a plastics material. The profile element is usually fabricated as an endless profile which is subsequently cut to the desired lengths for the frame.

Provided in the profile element, on the outer surface areas (face surface areas) thereof are grooves 6. These grooves 6 are configured trapezoidal so that they are tapered in the direction of the outer side of the profile element. Inserted into these grooves 6 are fastener strips 5 provided with Velcro hooks 4 at the side facing outwards in the fitted condition. In the embodiment as shown in FIGS. 1 and 2 two grooves 6 are provided on each face. Inserted into one of the grooves, namely the one located nearer to the trailing end of the frame, is a fastener strip including Velcro hooks 4. Inserted into the other groove 6 of the face, in the embodiment as shown, is a smooth profile strips 8 to thus result in a smooth and flat wipe surface area. As an alternative, it is, of course, just as possible to provide a second Velcro strip on each face, resulting in the mop cover being more securely affixed to the frame. The number of grooves is also not restricted to two per face surface area, instead any number of grooves may be provided, i.e. also just one groove or more than two. Unwanted detachment of these strips from the frame 2 is prevented by the trapezoidal configuration of the grooves 6 and of the supporting strips 5 for the fastener elements or profile strips 8.

The mop cover 3 is provided with correspondingly companion pieces to the Velcro hooks 4 on the profile strips 5, it more particularly featuring a corresponding loop fabric cooperating with the Velcro hooks 4. The outer side of the wipe mop cover 3 can be optionally selected in keeping with the requirements on the surface to be cleaned, for example loop fabric or the like.

As evident from FIG. 1, the profile element 13 is furthermore provided with longitudinally extending cavities. In the embodiment as shown the cavities are configured with a substantially rectangular cross-section. A cavity located on each side in the vicinity of the leading and trailing end features a round cross-section. In the embodiment as shown, the cavities are provided center-spaced in the thickness direction, although, of course, other arrangements are just as possible.

FIG. 1 also makes it clear how the cavities may differ in size. Thus, in the embodiment as shown, there is a middle cavity located substantially in the longitudinal centerline of the profile element and configured smaller than adjacent cavities. It is furthermore to be noted that in the embodiment as shown, the complete profile element 13 is symmetrical relative to a longitudinal centerline. This offers the advantage that in fabricating the frame each of the longitudinally extending edges of the original profile can be put to use as the leading or trailing edge.

Again as evident from FIG. 1, reinforcement parts 9 are inserted into the cavities of the profile element 13. The cross-section of these reinforcement parts 9 is adapted to those of the cavities 10 in thus enabling round reinforcement parts 12 or cornered reinforcement parts 9 to be provided. The number of reinforcement parts must not necessary be identical to the number of cavities 10 provided in the profile element 13. Instead, where smaller frames 2 are concerned, using reinforcement parts can often be eliminated. Reinforcement parts are of advantage more particularly when extra-long frames, exceeding for example 100 cm, are used, to endow these frames with the necessary stiffness. For shorter frames, for example 25 cm to 100 cm long, this is not a mandatory requirement, resulting in a lightweight frame construction when using a tubular section 13. Furthermore, the reinforcement parts 9, 12 may be inserted only in some of the cavities, depending on the requirements.

As regards the length of the reinforcement parts 9, 12, it is to be noted that these may substantially corresponding to the length of the profile element 13. Reinforcement parts 9, 12 somewhat longer than the profile element 13 as illustrated in FIG. 1 offer the advantage of permitting facilitated removal, when required. In this case, the ends of the reinforcement parts 9, 12 protruding from the profile element 13 are concealed by end caps. These end caps 7, as evident from FIG. 2, are applied to the side ends or in the vicinity thereof on the profile element 13, whereby use can be made, for example, of tongue-and-groove connections or snap-action fasteners.

As evident from FIG. 2, it is possible to configure the end caps as regards their outer definition lengthwise in accordance with the task involved. For example, it is thus good practice to shape the end caps 7 so that they render the profile element 13 trapezoidal, as viewed from above. This is of advantage in cleaning corners and edges difficult to access.

As evident from FIGS. 1 and 2, it is furthermore possible to employ a reinforcement part 12 inserted into a corresponding cavity in the vicinity of the trailing edge as the spindle for a universal joint 14 in attaching a handle to the frame. For this purpose, the profile element 13 comprises to advantage a recess 11 in the rear portion in the middle of the profile element 13 longitudinally which interrupts the recess into which the reinforcement element 12 serving as the spindle and of round cross-section, is inserted. A corresponding appendage on the handle forms, together with this spindle, a universal joint about which the frame can be pivoted so that each of the face surface areas can be used as the wipe surface area. In addition, providing a universal joint in the rear portion of the frame enables the orientation of the frame handle to be adapted to the requirements for facilitated handling by permitting, more particularly, the angle made by the handle to the frame to be varied.

The salient aspect of the invention is providing a frame for a wipe mop cover which can be made from an endless profile and which is suitable for reversible operation. This now permits cost-effective production of frames differing in size and geometrical configuration since recourse can be made to one and the same profile every time.

What is claimed is:

1. A frame for a wipe mop cover comprising a substantially flat profile element having two faces, two side ends, a leading end and a trailing end;

two end caps for application in the vicinity of said side ends on said profile element; and a universal joint for connecting a handle for application in the vicinity of said trailing end substantially in the middle thereof on said profile element and permitting rotation of said profile element about a spindle substantially parallel to said trailing end, wherein a recess extending full length in the thickness direction is provided in said profile element in the middle of said trailing end of said profile element.

2. The frame as set forth in claim 1, characterized in that said profile element is provided with at least one groove on at least one of said face surface areas.

3. The frame as set forth in claim 2 characterized in that said at least one groove has a trapezoidal cross section, said trapezoidal cross section being tapered towards the outer side of said profile element.

4. The frame as set forth in claim 1 characterized in that said profile element is configured as a tubular section having at least one cavity.

5. The frame as set forth in claim 4 characterized in that said at least one cavity extends full length in said profile element.

6. The frame as set forth in claim 5 characterized in that a cavity of round cross-section is provided extending in the vicinity of said trailing end substantially parallel thereto in said profile element.

7. The frame as set forth in claim 1 characterized in that provided in said profile element is a cavity of round cross-section, extending in the vicinity of said trailing end substantially parallel thereto and a recess extending full length in the thickness direction in the middle of said trailing end, said recess interrupting said round cavity in the longitudinal direction of said profile element.

8. The frame as set forth in claim 1 characterized in that said frame end caps render said profile element trapezoidal.

9. The frame as set forth in claim 1 characterized in that said profile element is substantially rectangular.

10. The frame as set forth in claim 1 characterized in that said profile element is symmetrical to a longitudinal centerline.

11. A wipe system comprising a frame as set forth in claim 2; and at least one strip insertable into at least one groove for securing a mop cover to said frame.

12. The wipe system as set forth in claim 11 characterized in that said strip is a hook and loop strip fastener.

13. The wipe system as set forth in claim 12 furthermore comprising a mop cover having hook and loop strip fasteners.

14. A wipe system comprising a frame as set forth in claim 5; and at least one reinforcement part insertable into at least one cavity.

15. A wipe system comprising a frame as set forth in claim 5; wherein the spindle is insertable into a round cavity and together with a companion piece on the handle forms the universal joint.

* * * * *